US011834220B2

(12) United States Patent
Ponti

(10) Patent No.: US 11,834,220 B2
(45) Date of Patent: Dec. 5, 2023

(54) WRAPPING MACHINE FOR WRAPPING A FILM ABOUT ARTICLES

(71) Applicant: C.M.C S.p.A., Cerbara-Citta' di Castello (IT)

(72) Inventor: Giuseppe Ponti, Citta' di Castello (IT)

(73) Assignee: C.M.C S.p.A., Cerbara-Citta' di Castello (IT)

( * ) Notice: Subject to any disclaimer, the term of this patent is extended or adjusted under 35 U.S.C. 154(b) by 266 days.

(21) Appl. No.: 17/312,832

(22) PCT Filed: Dec. 11, 2019

(86) PCT No.: PCT/IB2019/060667
§ 371 (c)(1),
(2) Date: Jun. 10, 2021

(87) PCT Pub. No.: WO2020/128731
PCT Pub. Date: Jun. 25, 2020

(65) Prior Publication Data

US 2022/0048655 A1 Feb. 17, 2022

(30) Foreign Application Priority Data

Dec. 17, 2018 (IT) ..... 102018000011148

(51) Int. Cl.
*B65B 9/06* (2012.01)
*B65B 35/24* (2006.01)
(Continued)

(52) U.S. Cl.
CPC ..... *B65B 9/06* (2013.01); *B65B 35/24* (2013.01); *B65B 41/12* (2013.01); *B65B 51/10* (2013.01); *B65B 61/06* (2013.01)

(58) Field of Classification Search
CPC ..... B65B 9/06; B65B 35/24; B65B 41/12; B65B 51/10; B65B 61/06; B65B 9/087; B65B 2220/08; B65B 9/067
See application file for complete search history.

(56) References Cited

U.S. PATENT DOCUMENTS 4,430,844 A 2/1984 James
4,549,389 A 10/1985 Wilson
(Continued)

FOREIGN PATENT DOCUMENTS

CN 1878696 A 12/2006
CN 203460190 U 3/2014
(Continued)

*Primary Examiner* — Anna K Kinsaul
*Assistant Examiner* — Veronica Martin
(74) *Attorney, Agent, or Firm* — R. Neil Sudol; Henry D. Coleman

(57) ABSTRACT

A machine for wrapping a film to form packs containing single articles includes a conveyor transporting the articles, an aspirated conveyor belt arranged consecutively to the conveyor, a supply station feeding a film and arranging the film with a central part resting on the conveyor belt and with lateral parts projecting from the belt, a frame associated with the conveyor belt and tunnel-conformed for passage of the articles, and folder means for abutting the projecting lateral parts of the film and winding the parts about the tunnel-conformed frame to form a tube of film about the tunnel-conformed frame. A glue device applies glue on one of the two flaps of the film and heat welding and cutting means are activatable for clamping the tube of film and heat-welding and cutting the film to obtain an envelope containing the article.

10 Claims, 8 Drawing Sheets

(51) Int. Cl.

| | |
|---|---|
| ***B65B 41/12*** | (2006.01) |
| ***B65B 51/10*** | (2006.01) |
| ***B65B 61/06*** | (2006.01) |

(56) References Cited

U.S. PATENT DOCUMENTS

| | | | | |
|---|---|---|---|---|
| 5,921,067 | A * | 7/1999 | Fujiwara | B65B 65/06 53/550 |
| 5,941,052 | A | 8/1999 | Evangelisti | |
| 6,050,057 | A * | 4/2000 | Tuyn | B65B 25/14 53/550 |
| 2007/0131739 | A1* | 6/2007 | Ponti | B65D 75/46 229/87.01 |
| 2009/0301037 | A1* | 12/2009 | Franzaroli | B65B 9/073 53/461 |
| 2018/0141686 | A1* | 5/2018 | Christman | B65B 59/001 |
| 2018/0290776 | A1 | 10/2018 | Cere | |

FOREIGN PATENT DOCUMENTS

| | | | |
|---|---|---|---|
| CN | 205167687 | U | 4/2016 |
| CN | 108928517 | A | 12/2018 |
| EP | 1364876 | A1 | 11/2003 |
| EP | 2314510 | B1 | 3/2016 |
| WO | WO 2018/102113 | A1 | 6/2018 |

* cited by examiner

WRAPPING MACHINE FOR WRAPPING A FILM ABOUT ARTICLES

The present invention relates to the technical sector concerning the packaging of articles by enveloping them with a film.

In particular, the present invention relates to a wrapping machine (M) for wrapping a film (P) about articles (A) to form closed packs (B) containing single articles.

In this particular technical sector the machines carrying out the winding of a film about an article to form a closed pack are commonly known as "cellophane wrapping machines", as, usually, the film used for the packaging is cellophane.

In cellophane wrapping machines, the articles are advanced one following another on conveyor means while the cellophane is unwound from a relative reel and, by supply means, is fed to the end of the conveyor means and transversally to the advancement direction of the articles.

The cellophane wrapping machines comprise relay means for arranging the cellophane so that a central part of the cellophane is brought into contact with an aspirated conveyor belt arranged consecutively to the conveyor means of the articles, and so that lateral parts of the film remain in lateral projection from the conveyor means.

The articles are advanced by the conveyor means so as to convey them above the central part of the cellophane arranged on the aspirated conveyor belt.

The aspirated conveyor belt then moves the cellophane with the articles arranged on the relative central part, retaining the cellophane by aspiration, moving both the cellophane and the articles arranged thereon at the same time in a transport direction.

On the basis of the dimensions of the articles which are to be wrapped, in particular the height thereof, fixed folder organs are located laterally to the conveyor belt, which are arranged with respect to the conveyor belt at a predetermined height, corresponding to the height of the articles, so as to abut the lateral parts of the cellophane projecting from the conveyor belt and fold the lateral parts above the articles, superposing the relative flaps one on another to form a sort of tube which wraps around the articles.

Glue application means are positioned above the conveyor belt, which are configured to apply glue on one of the two cellophane flaps and abutting means for abutting the two cellophane flaps superposed by the glue seal.

In this way a cellophane tube is created which is transported by the conveyor belt with the articles internally thereof, arranged one following another.

The cellophane wrapping machines also comprise, downstream of the glue application means, welding and cutting means which are located at an interruption of the conveyor belt and which are activatable to clamp the tube of cellophane and perform the heat-welding and therefore the cutting thereof.

In particular, the welding and cutting means are activatable to realise a heat-welding and a cut of the tube of cellophane immediately upstream and downstream of each article inside the tube of cellophane so as to obtain a closed pack with a single article inside.

These cellophane wrapping machines, however, present drawbacks.

In fact, owing to how they are made and structured, they can only be wound by the cellophane on a series of articles that have all the same height, as the folder means are arranged at a corresponding predetermined height with respect to the conveyor belt, so as to abut and fold the cellophane above the articles for the formation of the tube.

In a case where a second series of articles are to be wrapped, all having as same height but different from the height of the previous articles, it will be necessary to proceed to demounting the folder means and remounting them at a corresponding different height with respect to the conveyor belt.

Further, the cellophane wrapping machines at present available are not at all versatile, as they do not enable wrapping a series of articles having different shapes and heights with cellophane, i.e. it is not possible to position on the conveyor means, at random and time by time, articles having different dimensions and heights from one another.

The aim of the present invention is therefore to provide a novel wrapping machine for wrapping a film about articles to form closed packs containing single articles able to obviate the above-mentioned drawbacks.

In particular, an aim of the present invention is therefore to provide a novel wrapping machine able to wrap a film about articles having a shape, dimensions and height that are different to one another without any need to have to carry out demounting and remounting operations of components.

The above-cited aims are obtained by a wrapping machine according to claim 1.

Further characteristics and advantageous aspects of the wrapping machine of the invention are set down in the various dependent claims.

A preferred embodiment of the wrapping machine for winding a film about articles for forming closed packs containing single articles is described in the following with reference to the appended tables of drawings, in which.

Figure 1:
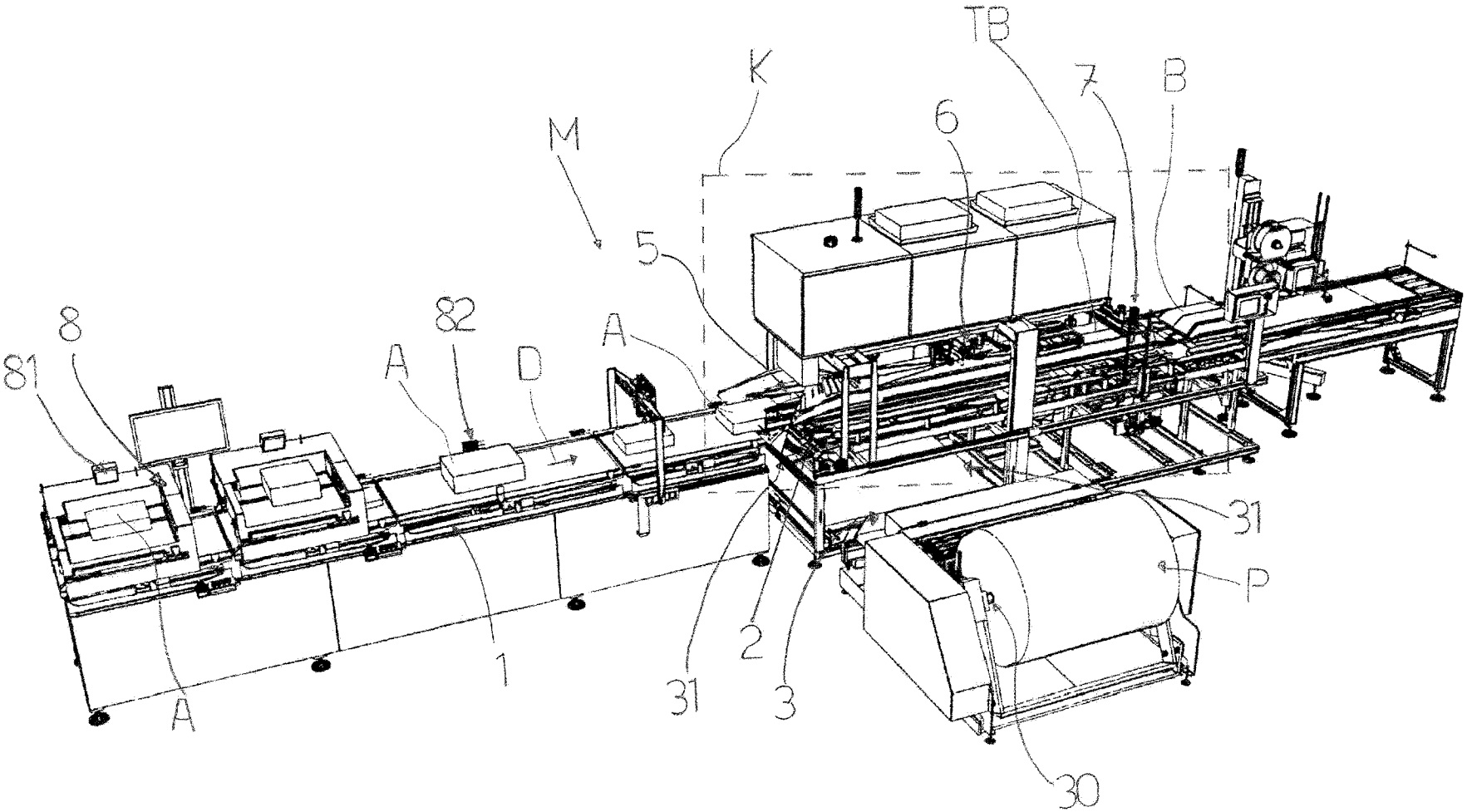
FIG. 1 is a schematic perspective view of the wrapping machine of the present invention.
Figure 2:
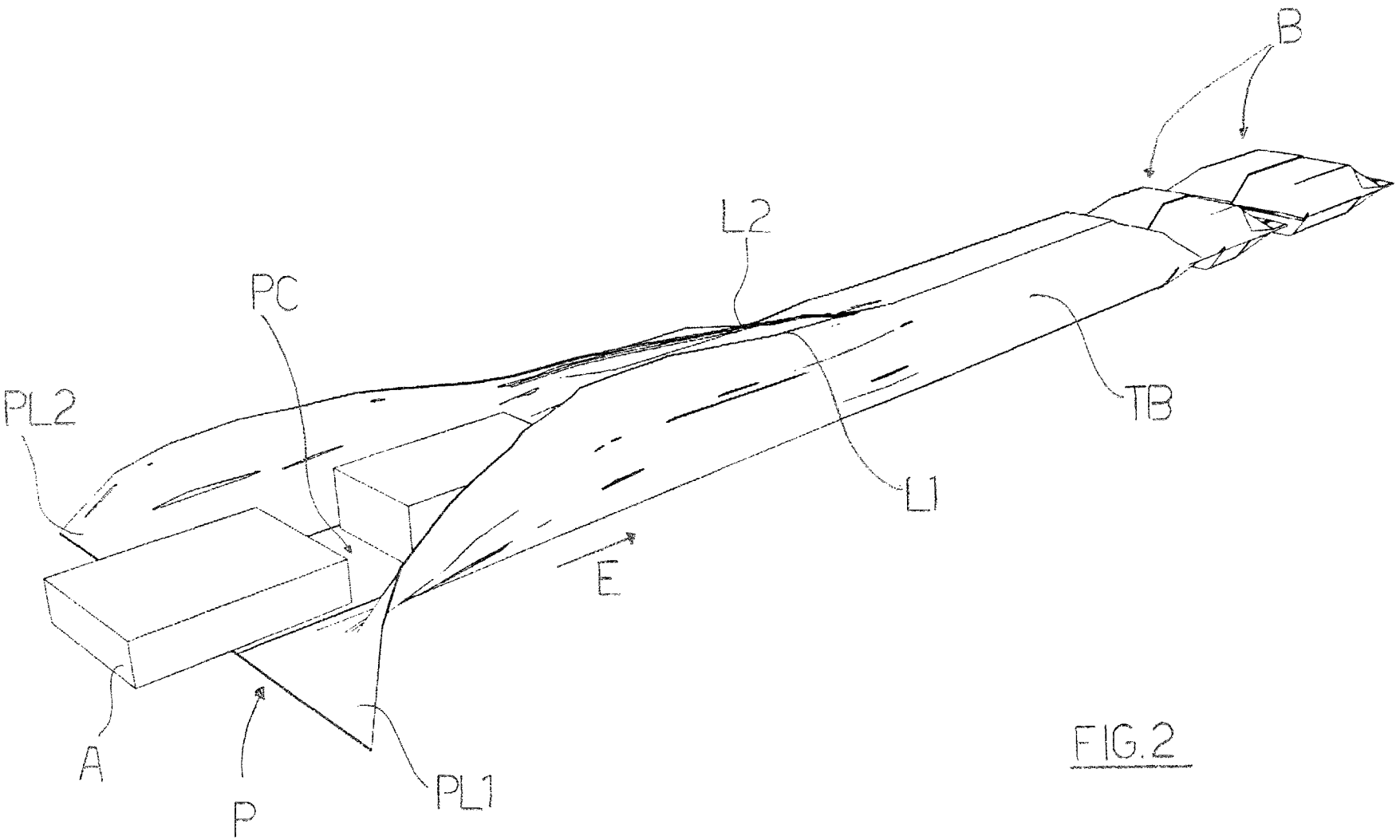
FIG. 2 is a schematic illustrated of the steps of the wrapping of the film about the articles and the obtaining of the packs containing single articles carried out by the wrapping machine.
Figure 3:
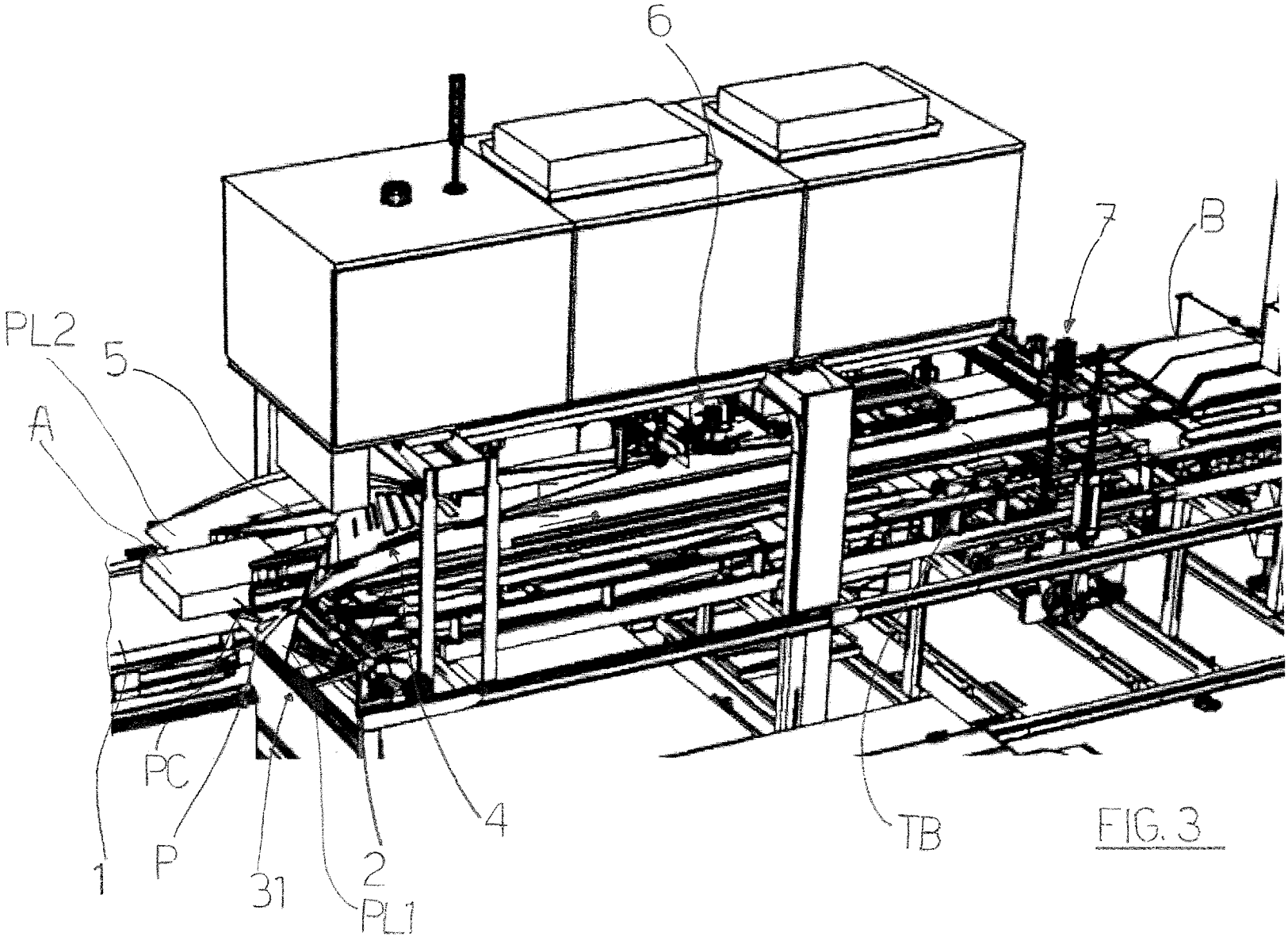
FIG. 3 illustrates detail K of FIG. 1 in larger scale.
Figure 4:
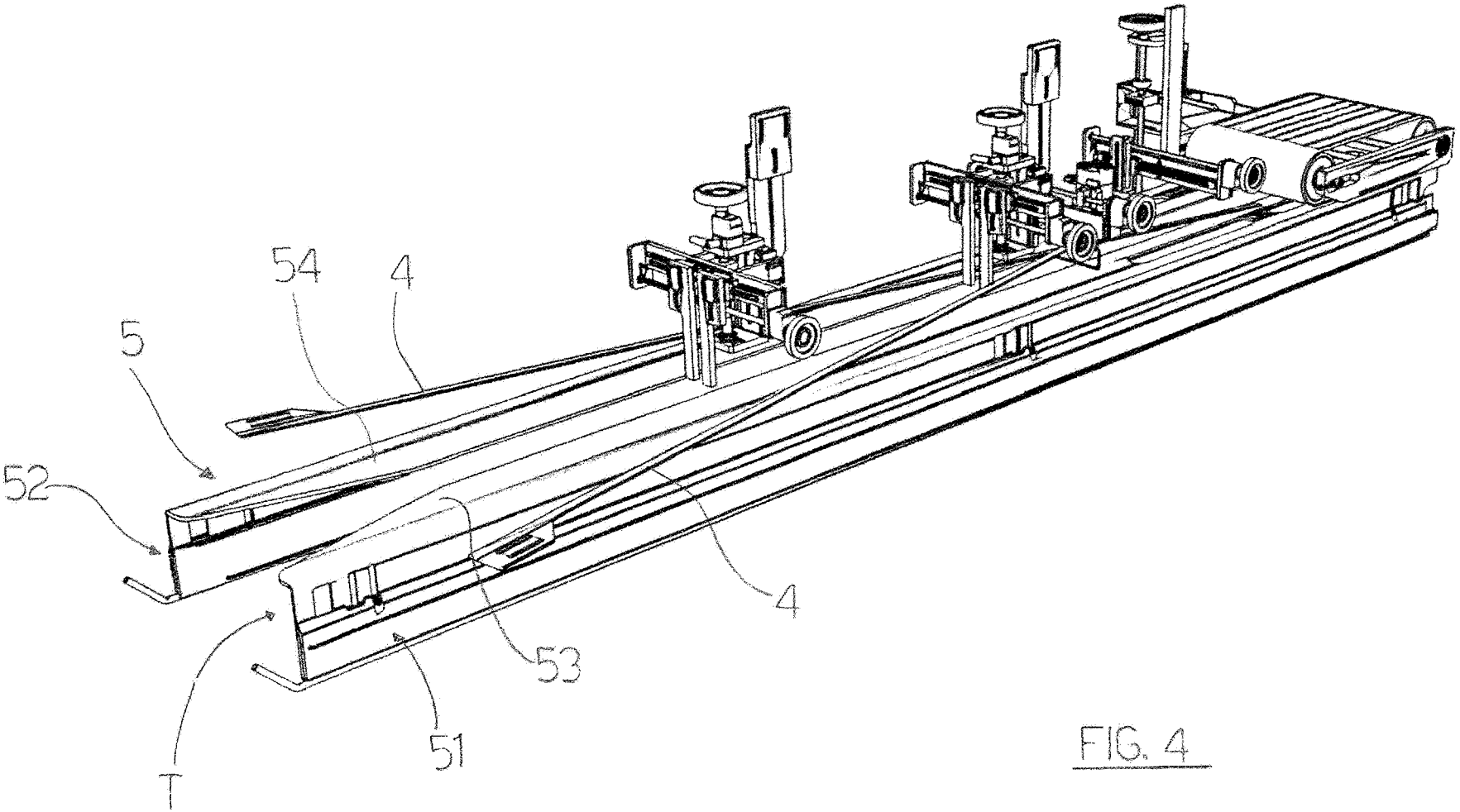
FIG. 4 illustrates, in a perspective exploded view, some significant components of the wrapping machine.
Figure 5:
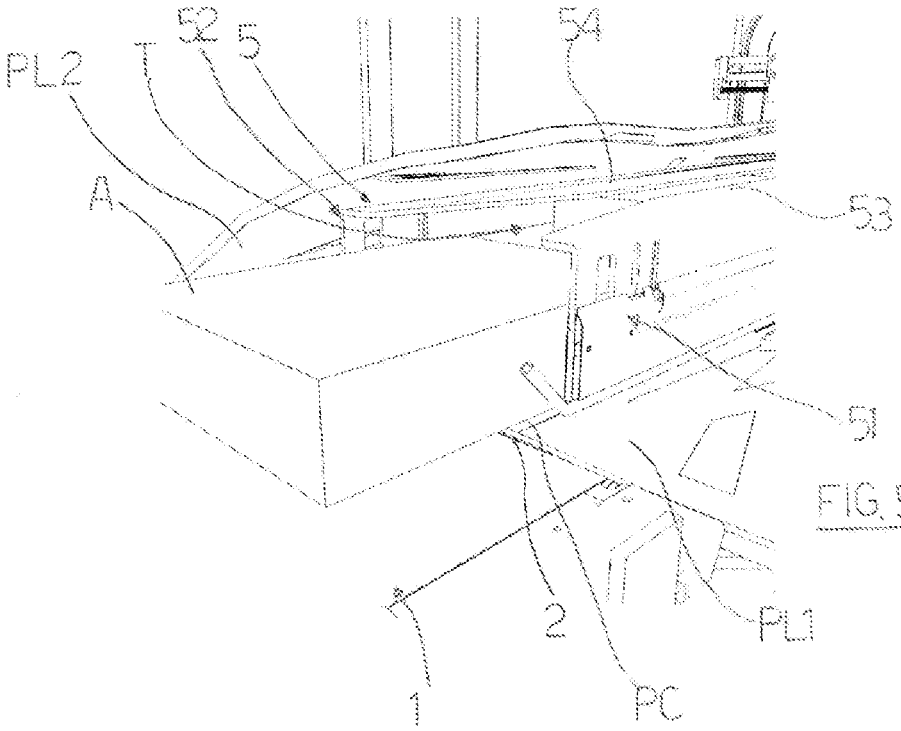
FIG. 5 is a schematic perspective view of the wrapping machine of the initial step of the film about an advancing article.
Figure 6:
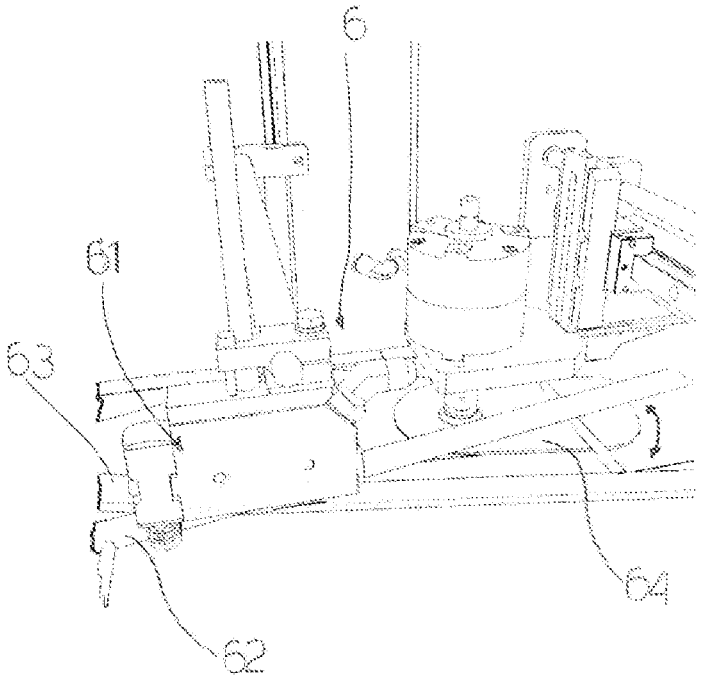
Figure 7:
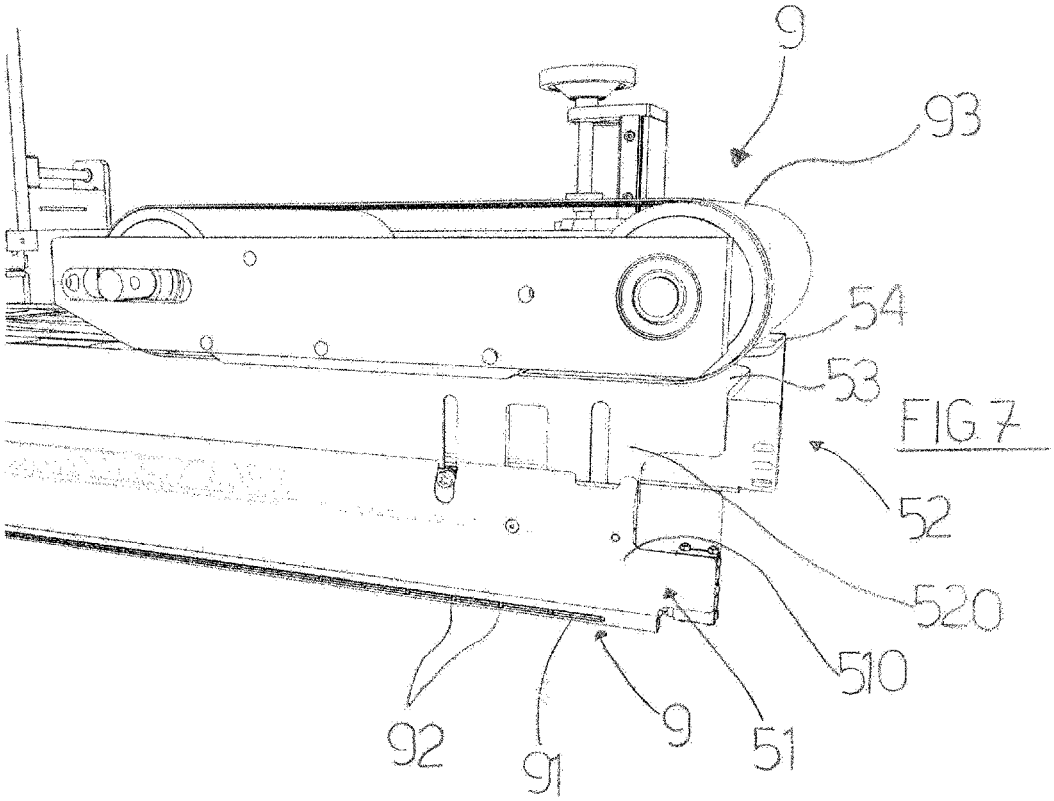
Figure 8:
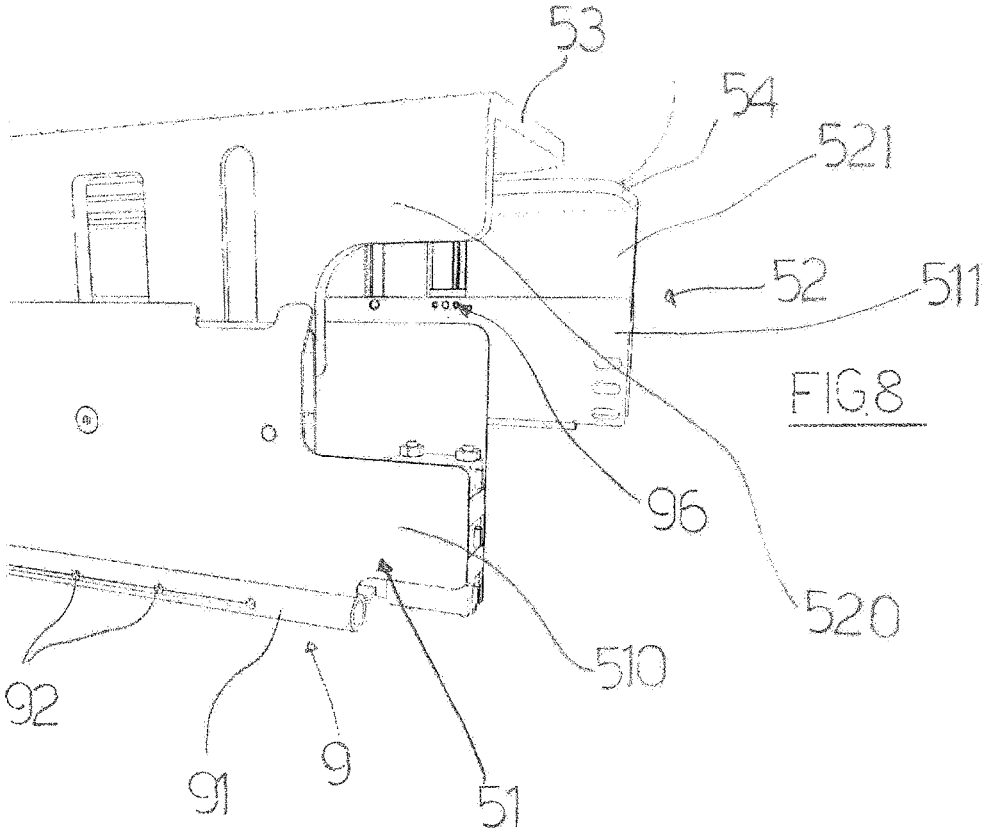
Figure 9A:
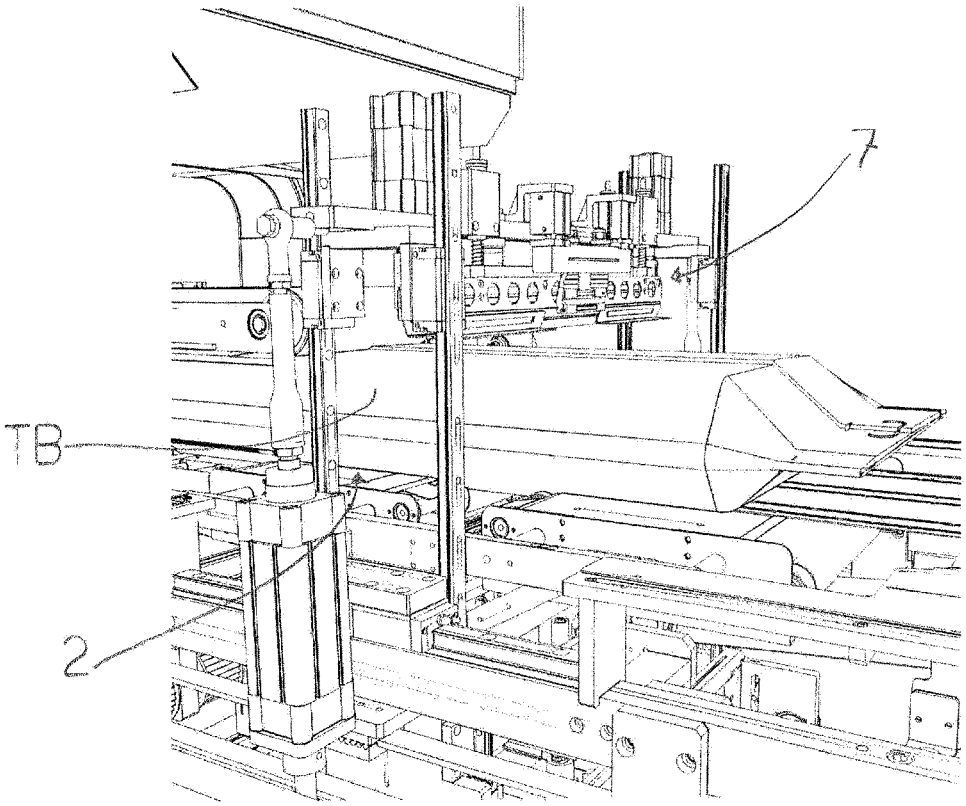
Figure 9B:
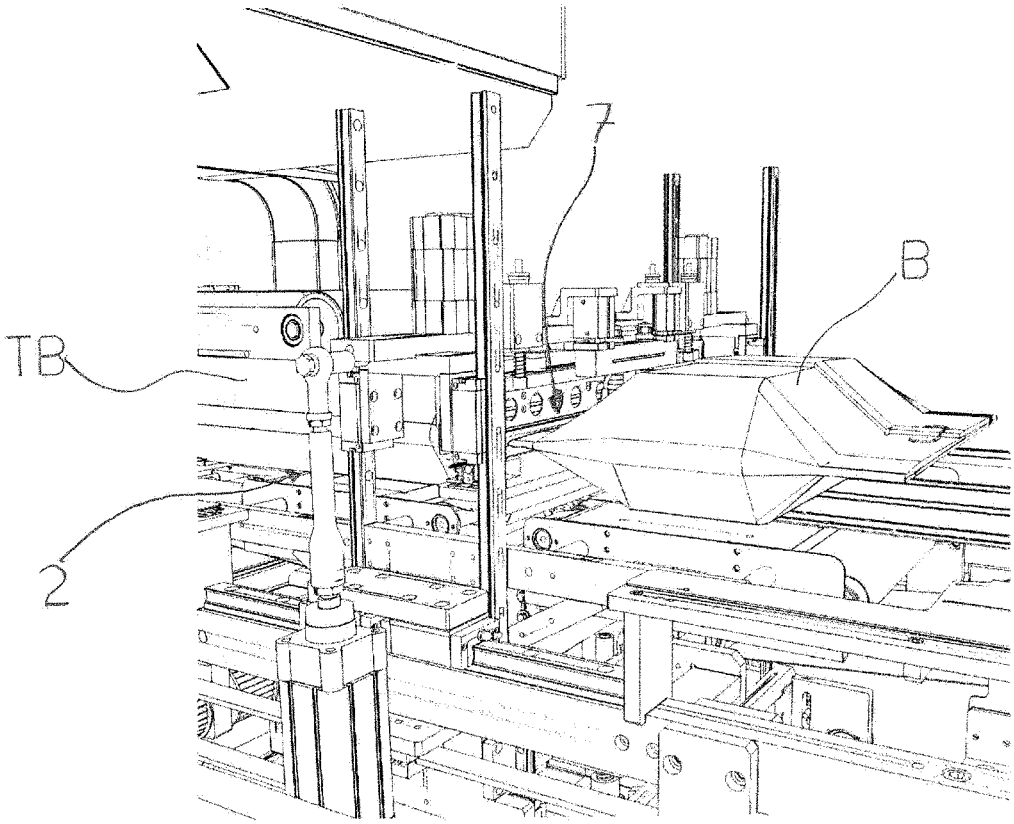
Figure 10:
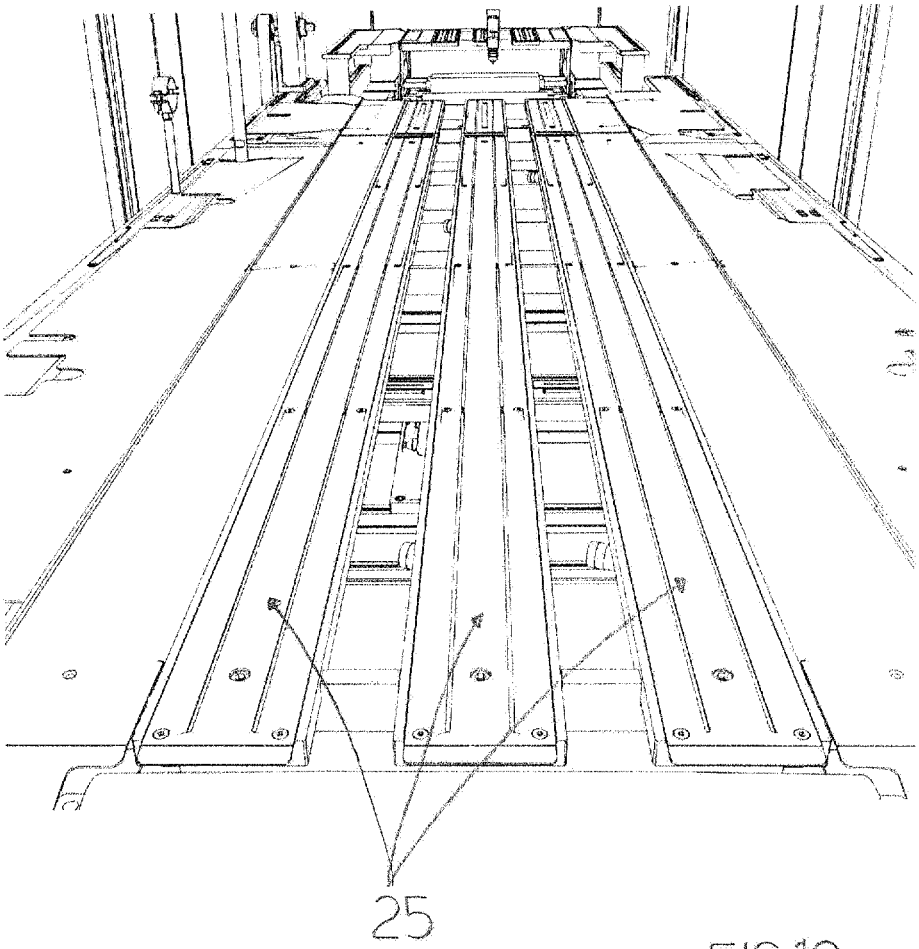

FIG. 6 schematically illustrates the components of the wrapping machine responsible for glue application;

FIG. 7 illustrates a schematic partial perspective view of other special components of the wrapping machine of the present invention;

FIG. 8 illustrates a schematic partial perspective view of other special components of the wrapping machine;

FIGS. 9A and 9B illustrate, in relative schematic perspective views, the step of realising the heat-welding and cutting of a portion of the film wrapped in tube fashion about an article for forming a relative pack;

FIG. 10 illustrates a schematic partial perspective view of other special components of the wrapping machine present beneath the advancement path of the articles in the wrapping zone of the film about them.

With reference to the appended tables of drawings, reference letter (M) denotes the wrapping machine (M) for wrapping a film (P) about articles (A) for forming packs (B) containing single articles according to the present invention, in its entirety.

The wrapping machine (M) comprises:

conveyor means (1), configured for receiving and conveying articles (A) which are to be wound about by a film according to a conveying direction (D);

an aspirated conveyor belt (2), arranged consecutively to the conveyor means (1);

a supply station (3) of a film (P), comprising a reel (30) on which a film (P) is wound and supply and relay means (31) for feeding the film (P) between the conveyor means (1) and the conveyor belt (2), transversally to the conveying direction (D) of the articles (A), and for arranging the film (P) with a relative central part (PC) resting on the conveyor belt (2) and with lateral parts (PL1, PL2) in relation to the central part (PC) laterally projecting from the conveyor belt (2), so that the articles (A) conveyed by the conveyor means (1) become arranged above the central part (PC) of the film (P) arranged resting on the conveyor belt (2) and so that the film (P) with the articles (A) arranged on the relative central part (PC) can be retained by aspiration by the aspirated conveyor belt (2) and advanced in a transport direction (E);

folder means (4), arranged and configured with respect to the conveyor belt (2) so as to be able to abut and fold the lateral parts (PL1, PL2) of the film (P) that are laterally projecting from the conveyor belt (2).

The peculiarities of the wrapping machine (M) consist in the fact that it comprises:

a frame (5) associated to the conveyor belt (2) and which is conformed in such a way as to define a tunnel (T) for passage of the articles (A) transported by the conveyor belt (2) above the central part (PC) of the film (P), the folder means (4) being conformed and configured in such a way as to abut the lateral parts (PL1, PL2) of the film (P) that are laterally projecting from the conveyor belt (2), during advancement thereof, and fold the lateral parts (PL1, PL2) of the film (P) about the tunnel-conformed (T) frame (5) so as to superpose the two lateral flaps (L1, L2) of the film (P) and form a tube of film (TB) wound about the tunnel-conformed (T) frame (5).

In particular, the tunnel-conformed (T) frame (5) is made in such a way that the tunnel (T) defines a passage space for passage of the articles (A) having a height with respect to the conveyor belt (2) such that internally thereof articles (A) can be conveyed that have different dimensions and heights, for example simply magazines, stacked magazines, boxes containing products, and so on. Further, the folder means (4) are arranged with respect to the conveyor belt (2), and with respect to the tunnel-conformed (T) frame (5), in such a way as to abut the lateral parts (PL1, PL2) of the film (P) that are laterally projecting from the conveyor belt (2) in order to fold them about the walls of the tunnel (T) so as to form a tube of film (TB) internally of which articles of various dimensions and heights are present.

In this way, with a single frame and a single configuration of the wrapping machine (M) (tunnel-conformed frame, folder means) it is possible to wrap a film about articles of different dimensions and height advancing along the conveyor belt, thus obviating the drawbacks present in the wrapping machines of known type mentioned in the foregoing.

Lastly, the wrapping machine (M) comprises:

glue application means (6), positioned above the tunnel-conformed (T) frame (5) and configured to apply glue on one of the two flaps (L1, L2) of the film (P) before superposing one thereof on the other;

heat welding and cutting means (7) positioned downstream of the tunnel-conformed (T) frame (5), at an interruption of the conveyor belt (2), and activatable for clamping the tube of film (TB) first anteriorly and then posteriorly with respect to the position of an article (A) in the tube of film (TB), so as to realise a heat-welding and cutting of the film (P) and obtain a pack (B) containing the article internally thereof.

From the above the advantages of the wrapping machine (M) of the invention emerge clearly, which machine is able to realise the wrapping of a film about articles that are different to one another, with different dimensions and heights, and obtain packs containing, internally thereof, single articles, without there being any need to stop the machine and the carrying out of demounting and remounting operations of components.

Other advantageous characteristics and aspect of the wrapping machine (M) are set out in the following.

The tunnel-conformed (T) frame (5) comprises lateral walls (51, 52) which are arranged along the sides of the conveyor belt (2) and at least an upper wall (53, 54), between the lateral walls (51, 52), while the folder means (4) are configured for folding the lateral parts (PL1, PL2) of the film (P) about the lateral walls (51, 52) and the upper wall (53, 54) of the tunnel-conformed (T) frame (5) so as to mutually superpose the two lateral flaps (L1, L2) of the film (P) and form the tube of film (TB) wound about the tunnel-conformed (T) frame (5).

The lateral walls (51, 52) of the tunnel-conformed (T) frame (5) can advantageously be realised in such a way as to comprise a fixed lower part (510, 511) and a movable upper part (520, 521) which is mounted translatably on the lower part (510, 511) and which bears the upper wall (53, 54).

In this way the position of the upper part (520, 521) of the lateral walls (51, 52) with respect to the lower part (510, 511) can be regulated and varied in order to vary the distance of the upper wall (53, 54) with respect to the conveyor belt (2) and thus vary the height of the tunnel (T) and adjust it to the various heights of the various articles which are to be wrapped in the film.

A further advantageous aspect of the wrapping machine of the invention consists in the fact that it comprises means (9) for creating an air cushion between the tube of film (TB) and the tunnel-conformed (T) frame (5). This specification enables preventing dragging and therefore friction between the film (P), and in particular the tube of film (TB) which is under formation, and the walls of the tunnel-conformed (T) frame (5).

In the particular embodiment illustrated in the figures, the means (9) for creating an air cushion can comprise pipes (91), connected to a source of compressed air, and provided with a series of holes (92) for air passage.

The pipes (91) are arranged in such a way as to be able to direct air jets exiting from the holes (92) towards parts of film (P) folded against the tunnel-conformed (T) frame (5).

For example, the pipes (91) can be arranged along at least a part of the two lateral walls (51, 52) of the tunnel-conformed (T) frame (5).

The means (9) for creating an air cushion can comprise an aspirating band (93) closed and loop-wound and arranged above the tunnel-conformed (T) frame (5) in a position that is such as to retain the parts of the film (P) folded above the tunnel-conformed (T) frame (5) by aspiration and activatable in such a way as to be able to accompany the film (P) in synchrony with the advancement thereof via the conveyor belt (2).

In a further advantageous aspect, the wrapping machine (M) comprises photo-detecting means (96) arranged along the tunnel (T) for detecting the passage of the articles (A) internally of the tunnel (T) and to detect the distance between the articles (A), and can be configured such that the heat welding and cutting means (7) are maintained non-operative when the photo-detecting means (96) detect that the distance between two consecutive articles is less than a predetermined minimum distance. This enables avoiding damage to articles which are too close to one another to have a sufficient space for the activating of the heat welding and cutting means (7).

In the illustrated preferred embodiment, the glue application means (6) comprise at least a glue dispenser (61), fixed abutting elements (62, 63) predisposed downstream of the dispenser (61), with respect to the transport direction (E) of the film (P), so as to superiorly abut the superposed flaps (L1, L2) of the film (P) and facilitate mutual adhesion thereof and at least a mobile abutting element (64) activatable in a case of halting of the conveyor belt (2) in order to be positioned above the two superposed flaps (L1, L2) of the film (P) and to maintain the flaps (L1, L2) mutually superposed and thus to maintain the tube of film (TB) closed.

The wrapping machine (M) further comprises aspirating elements (25) predisposed beneath the aspirating conveyor belt (2) so that the aspirated conveyor belt (2) retains by aspiration the central part (PC) of the film (P) arranged thereon during the movement of the film (P) along the transport direction (E).

An article loading station (8) can be provided, positioned at an initial part of the conveyor means (1) and provided with identifying means (81) configured to detect and identify an identifying code applied to the articles (A).

Lastly a further advantageous aspect relates to the fact that the wrapping machine (M) comprises detecting means (82) arranged along the conveyor means (1) to detect the height of the articles (A) and can be configured so that the conveyor means (1) are halted when the detecting means (82) detect passage of an article having a height greater than the height of the tunnel (T). With the wrapping machine (M) of the present invention, owing to the presence of the tunnel-conformed frame is it also possible to use damping packing films, known by the technical term "pluriball", for the wrapping of the articles, and therefore not just the usual cellophane.

The invention claimed is:

1. A wrapping machine for wrapping a film about articles for forming packs containing single articles, comprising:

conveyor means, configured for receiving and conveying articles which are to be wound about by the film according to a conveying direction;

an aspirated conveyor belt, arranged consecutively to the conveyor means;

a supply station of the film, comprising a reel on which a film is wound and supply and relay means for feeding the film between the conveyor means and the aspirated conveyor belt, transversally to the conveying direction of the articles, and for arranging the film with a relative central part resting on the aspirated conveyor belt and with lateral parts in relation to the central part laterally projecting from the aspirated conveyor belt, so that the articles conveyed by the conveyor means become arranged above the central part of the film arranged resting on the aspirated conveyor belt and so that the film with the articles arranged on the relative central part can be retained by aspiration by the aspirated conveyor belt and advanced in a transport direction;

folder means, arranged and configured with respect to the aspirated conveyor belt so as to be able to abut and fold the lateral parts of the film that are laterally projecting from the aspirated conveyor belt;

a frame associated to the aspirated conveyor belt and which is conformed in such a way as to define a tunnel-conformed frame for passage of the articles transported by the aspirated conveyor belt above the central part of the film, the folder means being conformed and configured in such a way as to abut the lateral parts of the film that are laterally projecting from the aspirated conveyor belt, during advancement thereof, and fold the lateral parts of the film about the tunnel-conformed frame so as to superpose two lateral flaps of the film and form a tube of film wound about the tunnel-conformed frame;

glue application means, positioned above the tunnel-conformed frame and configured to apply glue on one of the two lateral flaps of the film before superposing one thereof on the other;

heat welding and cutting means positioned downstream of the tunnel-conformed frame, at an interruption of the aspirated conveyor belt, and activatable for clamping the tube of film first anteriorly and then posteriorly with respect to the position of an article in the tube of film, so as to realise a heat-welding and cutting of the film and obtain a pack containing the article internally thereof; and means for creating an air cushion between the tube of film and the tunnel-conformed frame.

2. The wrapping machine of claim 1, wherein the tunnel-conformed frame comprises lateral walls which are arranged along the sides of the aspirated conveyor belt and at least an upper wall, between the lateral walls, and wherein the folder means are configured for folding the lateral parts of the film about the lateral walls and the upper wall of the tunnel-conformed frame so as to mutually superpose the two lateral flaps of the film and form the tube of film wound about the tunnel-conformed frame.

3. The wrapping machine of claim 2, wherein the lateral walls of the tunnel-conformed frame comprise a fixed lower part and a movable upper part which is mounted translatably on the lower part and which bears the at least an upper wall so that the position of the upper part with respect to the lower part can be regulated and varied in order to vary the distance of the upper wall with respect to the aspirated conveyor belt and thus vary the height of the tunnel-conformed frame.

4. The wrapping machine of claim 1, wherein the means for creating an air cushion comprise pipes, connected to a source of compressed air, and provided with a series of holes for air passage, the pipes being arranged in such a way as to be able to direct air jets exiting from the holes towards parts of film folded against the tunnel-conformed frame.

5. The wrapping machine of claim 1, wherein the means for creating an air cushion comprise an aspirating band closed and loop-wound and arranged above the tunnel-conformed frame in a position that is such as to retain the parts of the film folded above the tunnel-conformed frame by aspiration and activatable in such a way as to be able to accompany the film in synchrony with the advancement thereof via the aspirated conveyor belt.

6. The wrapping machine of claim 1, wherein the glue application means comprise at least a glue dispenser, fixed abutting elements predisposed downstream of the dispenser, with respect to the transport direction of the film, so as to superiorly abut the superposed flaps of the film and facilitate mutual adhesion thereof and at least a mobile abutting element activatable in a case of halting of the aspirated conveyor belt in order to be positioned above the two superposed flaps of the film and to maintain the flaps mutually superposed and thus to maintain the tube of film closed.

7. The wrapping machine of claim 1, comprising aspirating elements predisposed beneath the aspirated conveyor belt so that the aspirated conveyor belt retains by aspiration the central part of the film arranged thereon during the movement of the film along the transport direction.

8. The wrapping machine of claim 1, comprising an article loading station positioned at an initial part of the conveyor means and provided with identifying means configured to detect and identify an identifying code applied to the articles.

9. The wrapping machine of claim 1, comprising detecting means arranged along the conveyor means and configured to detect the height of the articles and wherein the conveyor means are configured to be halted when the detecting means detect passage of an article having a height greater than the height of the tunnel-conformed frame.

10. A wrapping machine for wrapping a film about articles for forming packs containing single articles, comprising:

conveyor means, configured for receiving and conveying articles which are to be wound about by the film according to a conveying direction;

an aspirated conveyor belt, arranged consecutively to the conveyor means;

a supply station of the film, comprising a reel on which a film is wound and supply and relay means for feeding the film between the conveyor means and the aspirated conveyor belt, transversally to the conveying direction of the articles, and for arranging the film with a relative central part resting on the aspirated conveyor belt and with lateral parts in relation to the central part laterally projecting from the aspirated conveyor belt, so that the articles conveyed by the conveyor means become arranged above the central part of the film arranged resting on the aspirated conveyor belt and so that the film with the articles arranged on the relative central part can be retained by aspiration by the aspirated conveyor belt and advanced in a transport direction;

folder means, arranged and configured with respect to the aspirated conveyor belt so as to be able to abut and fold the lateral parts of the film that are laterally projecting from the aspirated conveyor belt;

a frame associated to the aspirated conveyor belt and which is conformed in such a way as to define a tunnel-conformed frame for passage of the articles transported by the aspirated conveyor belt above the central part of the film, the folder means being conformed and configured in such a way as to abut the lateral parts of the film that are laterally projecting from the aspirated conveyor belt, during advancement thereof, and fold the lateral parts of the film about the tunnel-conformed frame so as to superpose two lateral flaps of the film and form a tube of film wound about the tunnel-conformed frame;

glue application means, positioned above the tunnel-conformed frame and configured to apply glue on one of the two lateral flaps of the film before superposing one thereof on the other;

heat welding and cutting means positioned downstream of the tunnel-conformed frame, at an interruption of the aspirated conveyor belt, and activatable for clamping the tube of film first anteriorly and then posteriorly with respect to the position of an article in the tube of film, so as to realise a heat-welding and cutting of the film and obtain a pack containing the article internally thereof; and photo-detecting means arranged along the tunnel-conformed frame and configured to detect the passage of the articles internally of the tunnel-conformed frame and to detect the distance between the articles and wherein the heat welding and cutting means are configured in such a way as to be non-operative when the photo-detecting means detect that the distance between two consecutive articles is less than a predetermined minimum distance.

* * * * *